US007528819B2

(12) United States Patent
Lin et al.

(10) Patent No.: US 7,528,819 B2
(45) Date of Patent: May 5, 2009

(54) SOURCE DRIVER AND THE DATA SWITCHING CIRCUIT THEREOF

(75) Inventors: Che-Li Lin, Taipei (TW); Chang-San Chen, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 640 days.

(21) Appl. No.: 11/162,837

(22) Filed: Sep. 26, 2005

(65) Prior Publication Data

US 2007/0013640 A1 Jan. 18, 2007

(30) Foreign Application Priority Data

Jul. 12, 2005 (TW) ..... 94123503 A

(51) Int. Cl.
*G09G 3/36* (2006.01)

(52) U.S. Cl. ..... 345/100; 345/98

(58) Field of Classification Search ..... 345/42, 345/48, 54–55, 92–96, 87–89, 98–100, 211
See application file for complete search history.

(56) References Cited

U.S. PATENT DOCUMENTS

2003/0151584 A1* 8/2003 Song et al. ..... 345/100
2003/0197668 A1* 10/2003 Song et al. ..... 345/87
2003/0197672 A1* 10/2003 Yun et al. ..... 345/99
2003/0197815 A1* 10/2003 Choi et al. ..... 349/43
2004/0125067 A1* 7/2004 Kim et al. ..... 345/98
2005/0200585 A1* 9/2005 Igarashi et al. ..... 345/93

OTHER PUBLICATIONS

English translation of KR 2003050895.*
Drawings of KR 2003050895.*

* cited by examiner

*Primary Examiner*—Amare Mengistu
*Assistant Examiner*—Hong Zhou
(74) *Attorney, Agent, or Firm*—Jianq Chyun IP Office

(57) ABSTRACT

A data switching circuit is provided, which reduces power consumption of the source drivers when used together with a dot inversion driving method. The circuit comprises a control unit and a switching unit. Wherein, the control unit provides a switching signal. The switching unit has 2N input terminals and 2N output terminals and receives the switching signal. Assume that N is a positive integer and $1 \leqq i \leqq N$. When the switching signal is in a first state, the switching unit connects the $(2i-1)^{th}$ input terminal and the $(2i-1)^{th}$ output terminal, and connects the $2i^{th}$ input terminal and the $2i^{th}$ output terminal. When the switching signal is in a second state, the switching unit connects the $2i^{th}$ input terminal and the $(2i-1)^{th}$ output terminal, and connects the $(2i-1)^{th}$ input terminal and the $2i^{th}$ output terminal.

20 Claims, 7 Drawing Sheets

| | | | | | |
|---|---|---|---|---|---|
| + | − | + | − | + | − |
| − | + | − | + | − | + |
| + | − | + | − | + | − |
| − | + | − | + | − | + |
| + | − | + | − | + | − |

Frame T

| | | | | | |
|---|---|---|---|---|---|
| − | + | − | + | − | + |
| + | − | + | − | + | − |
| − | + | − | + | − | + |
| + | − | + | − | + | − |
| − | + | − | + | − | + |

Frame T+1

SOURCE DRIVER AND THE DATA SWITCHING CIRCUIT THEREOF

CROSS-REFERENCE TO RELATED APPLICATION

This application claims the priority benefit of Taiwan application serial no. 94123503, filed on Jul. 12, 2005. All disclosure of the Taiwan application is incorporated herein by reference.

BACKGROUND OF THE INVENTION

1. Field of the Invention

The present invention relates to a source driver and a data switching circuit thereof, and more particularly, to a source driver using a dot inversion driving method and a data switching circuit thereof.

2. Description of the Related Art

The source driver is a key component in the Thin Film Transistor Liquid Crystal Display (TFT LCD) for converting a digital data signal required for displaying image into an analog signal, and providing the analog signal to each sub-pixel (also known as a dot) of the TFT LCD.

FIG. 1 is a block diagram illustrating the major structures of a conventional source driver 100. Referring to FIG. 1, the source driver 100 receives a data signal 110 and outputs the analog signals from its N output channels $Y_1$~$Y_N$. The source driver 100 includes a shift register 101, a line latch 102, a level shifter 103, a digital-to-analog converter (DAC) 104, and an output buffer 105. In general, the source driver is a conventional art and its structures and functions are apparent to one of the ordinary skill in the art. The process is briefly described below. First, a data signal 110 is dispatched by the shift register 101 and output to output channels $Y_1$~$Y_N$. Then, the output from the output channels $Y_1$~$Y_N$ are temporarily stored in the line latch 102 and then amplified by the level shifter 103. Finally, the DAC 104 converts the amplified data signals into analog signals, which are then outputted by the output buffer 105.

Since the TFT LCD uses liquid crystal for controlling the display, the TFT LCD must be driven by an alternating current (AC) to avoid the liquid crystal material from being polarized. Accordingly, a variety of inversion driving methods, such as line inversion, column inversion, and dot inversion are developed. Wherein, the dot inversion driving method is shown in FIG. 2. FIG. 2 schematically shows the driving polarity of the sub-pixel in TFT LCD in a frame T and the next frame T+1, where "+" represents a positive driving polarity, and "−" represents a negative driving polarity. As shown in FIG. 2, the so-called dot inversion means that both neighboring sub-pixels in the same frame have opposite driving polarities in their horizontal and vertical directions, and the driving polarity of the same sub-pixel will be inversed as it goes to the next frame.

Although the dot inversion driving method has many advantages, its major disadvantage is the consumption of excessive power. Referring to FIG. 3, the source driver 301 in FIG. 3 outputs the analog signals to the sub-pixels SP0~SP3 located on the same scan line in a pixel array 303 through the output buffer 302 and the data lines DL0~DL3. The larger-screen TFT LCD panel in current market adopts the direct current (DC) common voltage Vcom design, and having a positive polarity voltage and a negative polarity voltage. Wherein, the positive polarity voltage is higher than the common voltage Vcom, and the negative polarity voltage is lower than the common voltage Vcom. For example, the sequence of the voltage polarity output from the data lines DL0 and DL2 is positive, negative, and positive; and the sequence of the voltage polarity output from the data lines DL1 and DL3 is negative, positive, and negative. Each time as it enters into the next scan line or the next frame, the polarity of the voltage on the data lines DL0~DL3 must be inversed. Therefore, the source driver 310 should provide a swing voltage Vswing that is twice of the common voltage Vcom. The greater the swing voltage Vswing is, the greater the power is consumed. Along with the increasing of panel size and the resolution, a higher voltage is required to drive the wide view angle technology such as the in-plane switching (IPS) and the multi-domain vertical alignment (MVA). As a result, the problem is made more serious.

SUMMARY OF THE INVENTION

Therefore, an object of the present invention is to provide a data switching circuit, which reduces the swing voltage output from a source driver and further reduces the power consumption when used together with a dot inversion driving method.

Another object of the present invention is to provide a source driver, which is used together with a dot inversion driving method to have the output channel that only outputs a positive polarity voltage or a negative polarity voltage, such that the power consumption is reduced.

To achieve the objects mentioned above and others, the present invention provides a data switching circuit, which includes a control unit and a switching unit. In which, the control unit provides a switching signal. The switching signal may be either in a first state or in a second state, and the state of the switching signal is changed every time when the frame and the scan line in the TFT LCD are started. The switching unit has 2N input terminals and 2N output terminals for receiving the switching signal. Assume that N is a positive integer and $1 \leqq i \leqq N$. When the switching signal is in a first state, the switching unit connects the $(2i-1)^{th}$ input terminal and the $(2i-1)^{th}$ output terminal, and connects the $2i^{th}$ input terminal and the $2i^{th}$ output terminal. When the switching signal is in a second state, the switching unit connects the $2i^{th}$ input terminal and the $(2i-1)^{th}$ output terminal, and connects the $(2i-1)^{th}$ input terminal and the $2i^{th}$ output terminal.

In the aforementioned data switching circuit according to an embodiment of the present invention, the input terminal of the switching unit is electrically coupled to the line latch of the source driver, and the output terminal of the switching unit is electrically coupled to the level shifter of the same source driver.

In accordance with another aspect, the present invention further provides a source driver, which comprises a line latch, a control unit, a switching unit, and a DAC. In which, the control unit provides a switching signal. The switching signal may be either in a first state or in a second state, and the state of the switching signal is changed every time when the frame and the scan line in the TFT LCD are started. The switching unit has 2N input terminals and 2N output terminals. The input terminal mentioned above is electrically coupled to the line latch. Assume that N is a positive integer and $1 \leqq i \leqq N$. When the switching signal is in a first state, the switching unit connects the $(2i-1)^{th}$ input terminal and the $(2i-1)^{th}$ output terminal, and connects the $2i^{th}$ input terminal and the $2i^{th}$ output terminal. When the switching signal is in a second state, the switching unit connects the $2i^{th}$ input terminal and the $(2i-1)^{th}$ output terminal, and connects the $(2i-1)^{th}$ input terminal and the $2i^{th}$ output terminal. In addition, the DAC is electrically coupled to the output terminal of the switching unit.

In accordance with a preferred embodiment of the present invention, a special designed data switching circuit is used to switch the data signal in pairs between the output channels of the source driver, and a special designed pixel array is used to transmit the switched data signal to the proper sub-pixel. In addition, if the dot inversion driving method is used, a positive polarity voltage or a negative polarity voltage is continuously outputted from the same output channel during the same frame, such that the switching between the positive polarity and the negative polarity is eliminated. Accordingly, the swing voltage output from the source driver is reduced, and the power consumption is further reduced.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF EMBODIMENTS

Figure 4:
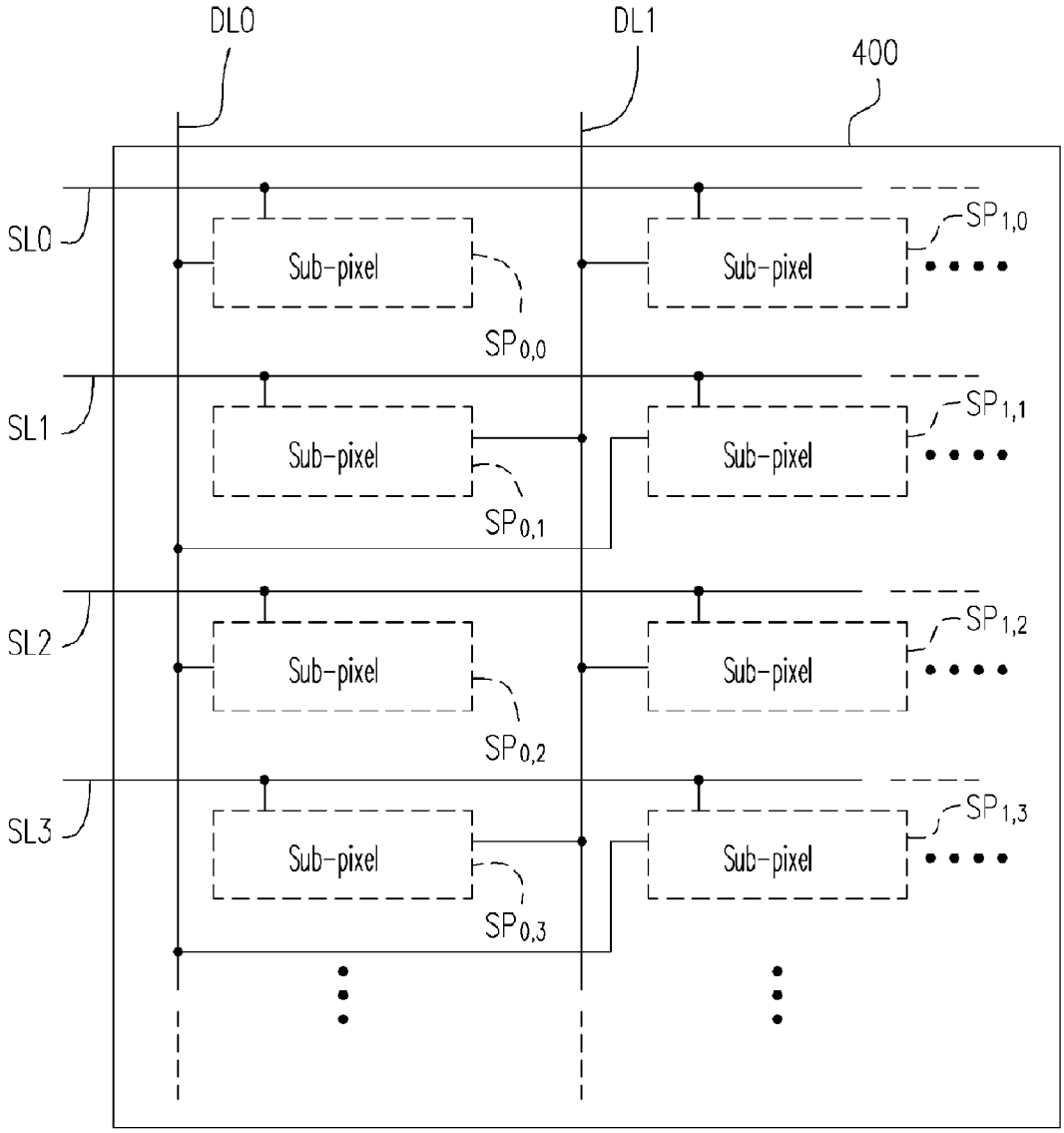
FIG. 4 is a schematic diagram schematically illustrating a pixel array used in an embodiment of the present invention.

As described above, a special designed data switching circuit is used together with a special designed pixel array in the present invention. FIG. 4 schematically illustrates a portion of the pixel array 400 used in an embodiment of the present invention. The aforementioned portion includes the data lines DL0~DL1, the scan lines SL0~SL3, and 8 sub-pixels. In which, the sub pixel $SP_{0,0}$ is electrically coupled to the data line DL0 and the scan line SL0, the sub pixel $SP_{1,0}$ is electrically coupled to the data line DL1 and the scan line SL0, the sub pixel $SP_{0,1}$ is electrically coupled to the data line DL1 and the scan line SL1, the sub pixel $SP_{1,1}$ is electrically coupled to the data line DL0 and the scan line SL1, and other sub pixels are extended along with the horizontal and vertical directions, following the same rules. In other words, if both x and y are even numbered, the sub pixel $SP_{x,y}$ is electrically coupled to the data line DL(x) and the scan line SL(y), the sub pixel $SP_{x+1,y}$ is electrically coupled to the data line DL(x+1) and the scan line SL(y), the sub pixel $SP_{x,y+1}$ is electrically coupled to the data line DL(x+1) and the scan line SL(y+1), and the sub pixel $SP_{x+1,y+1}$ is electrically coupled to the data line DL(x) and the scan line SL(y+1).

Figure 1:
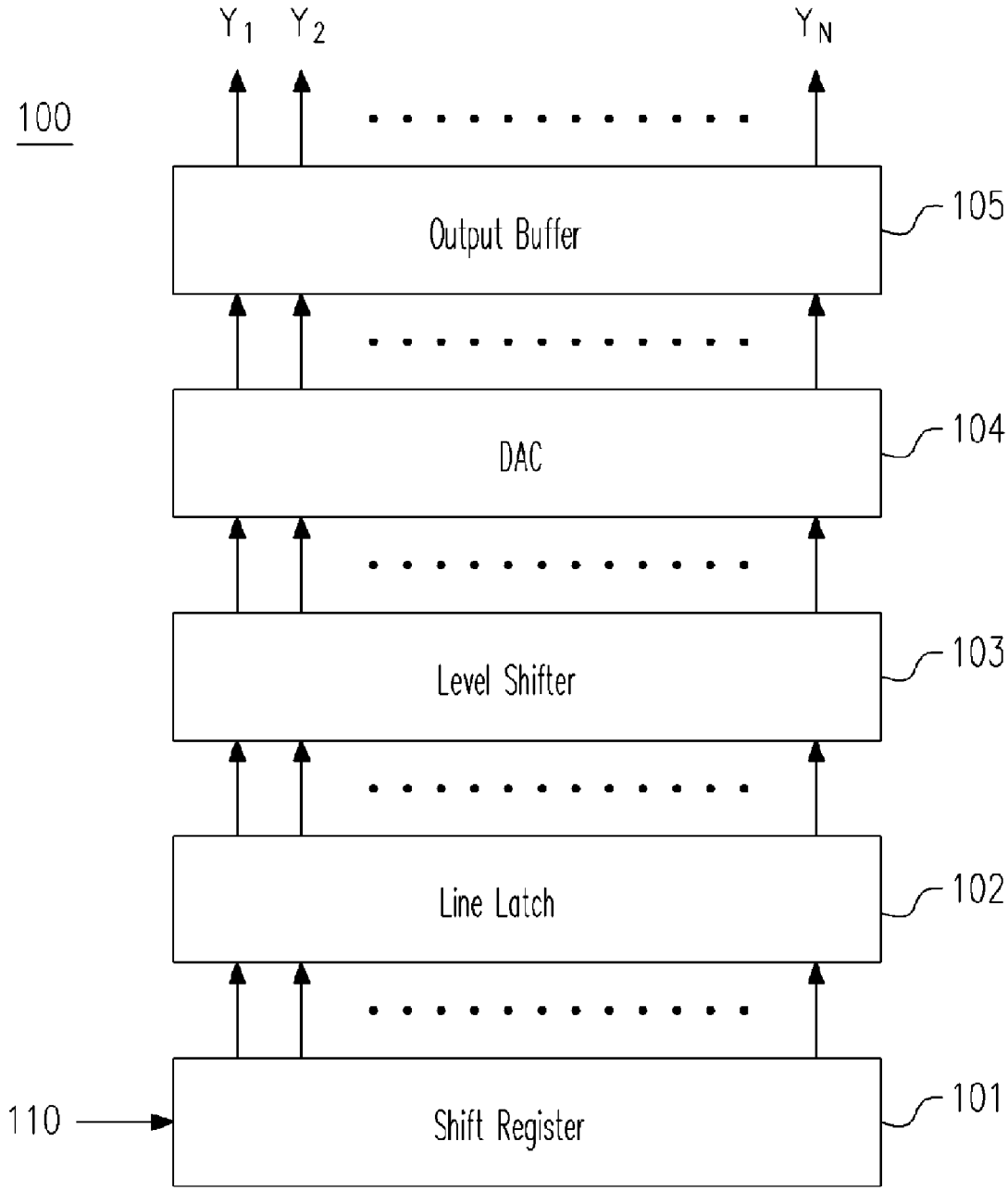
FIG. 1 (PRIOR ART)
FIG. 1 is a block diagram illustrating the major structure of a conventional source driver.
Figures 2, 3:
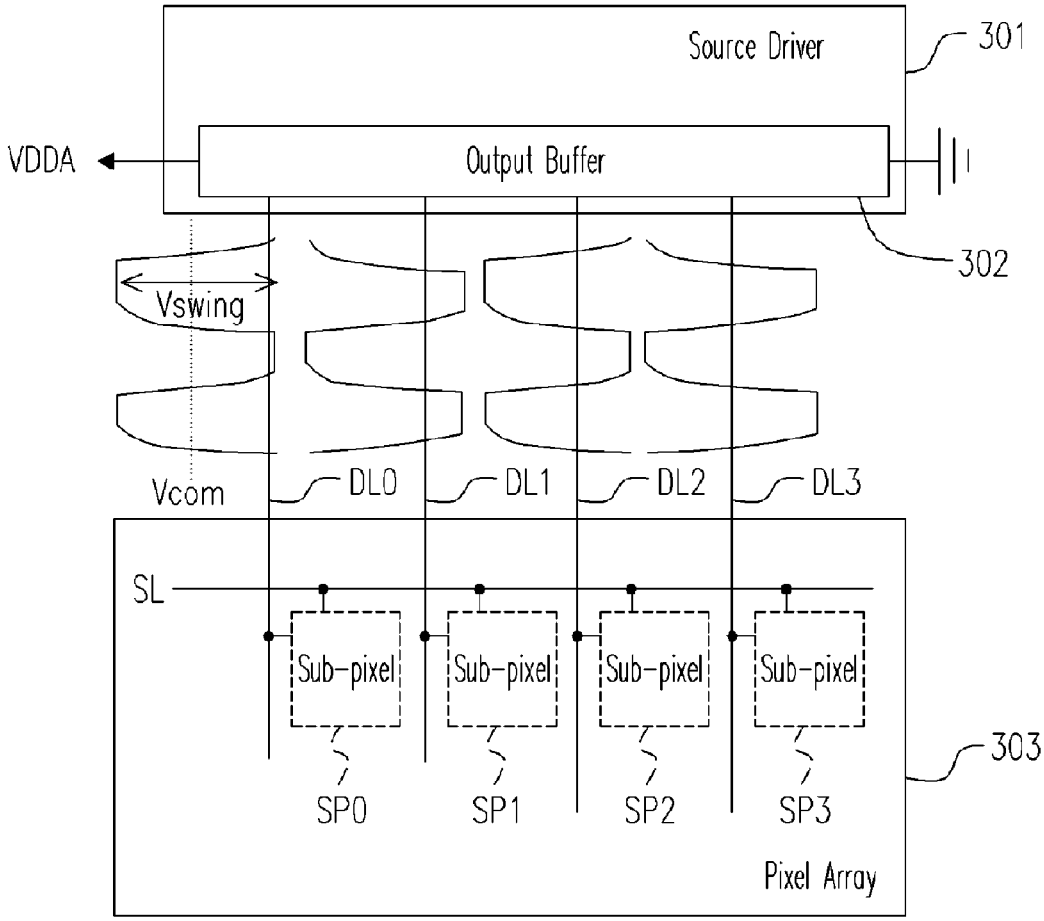
FIG. 3 (PRIOR ART)
FIG. 2 is a schematic diagram illustrating a dot inversion driving method.
FIG. 3 is a waveform schematic diagram of a conventional dot inversion driving signal.
Figure 5:
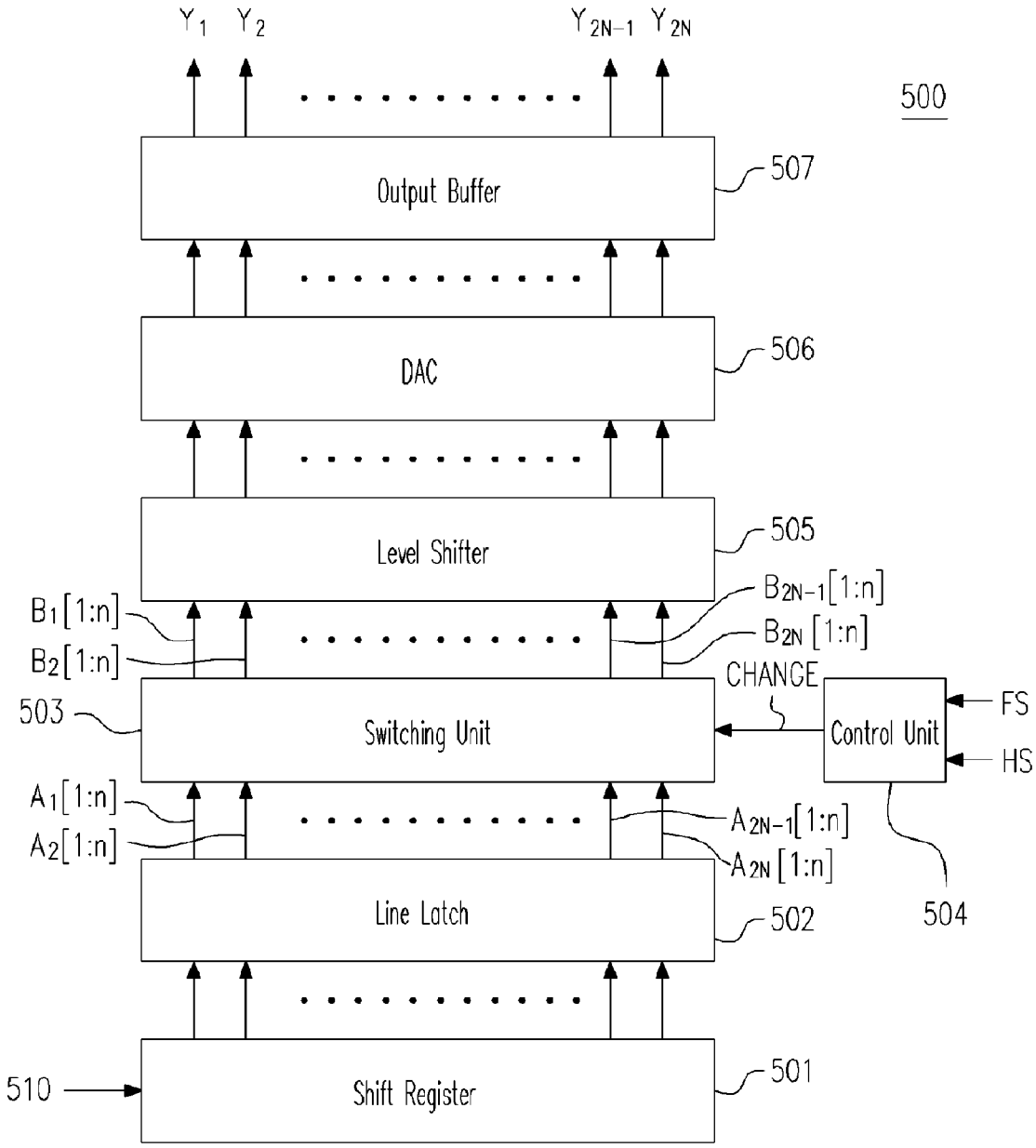
FIG. 5 is a block diagram illustrating the major structures of a source driver, according to an embodiment of the present invention.

FIG. 5 is a block diagram illustrating the major structures of a source driver 500, according to an embodiment of the present invention. The source driver 500 includes a shift register 501 receiving a data signal 510, a line latch 502 electrically coupled to the shift register 501, a control unit 504 generating a switching signal CHANGE, a switching unit 503 receiving the switching signal CHANGE, a level shifter 505 electrically coupled to the output terminal of the switching unit 503, a DAC 506 electrically coupled to the level shifter 505, and an output buffer 507 electrically coupled to the DAC 506. In addition, the data switching circuit of the present embodiment includes the switching unit 503 and the control unit 504. Unless described specifically, the rest of the components all have the same functions as the components with the same names in FIG. 1.

Figure 6:
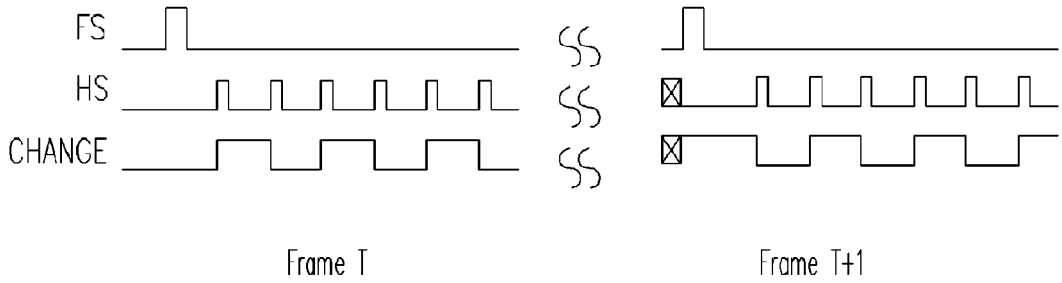
FIG. 6 is a signal timing diagram of the control unit in FIG. 5.

In the present embodiment, the control unit 504 receives a frame start signal FS and a scan line start signal HS, and generates a switching signal CHANGE according to these two signals. As show in FIG. 6, the frame start signal FS is synchronized with each frame start of the TFT LCD, and the scan line start signal HS is synchronized with each scan line start. Each time when the frame and the scan line are started, the switching signal CHANGE is to change its state for adapting with the change of the sub pixel driving polarity. A couple of the existing signals in the TFT LCD may be utilized by the control unit 504. For example, the frame start signal FS may be from the vertical synchronization signal or from the start pulse signal that is provided to the gate driver, and the scan line start signal HS may be from the horizontal synchronization signal or from the latch data signal that is provided to the source driver.

In the present embodiment, there are 2N data lines in the pixel array 400, and the gray scale resolution for each sub pixel is n bits, in which both N and n are positive integers. Therefore, the source driver 500 has 2N output channels $Y_1$~$Y_{2N}$, and the switching unit 503 also has 2N input signals $A_1$~$A_{2N}$ and 2N output signals $B_1$~$B_{2N}$. Of course, the input signals $A_1$~$A_{2N}$ and the output signals $B_1$~$B_{2N}$ are the n-bit digital signals. The switching unit 503 changes the connection relationship between the output signals $B_1$~$B_{2N}$ and the input signals $A_1$~$A_{2N}$ according to the state of the switching signal CHANGE, and its details are as shown in FIG. 7.

Figure 7:
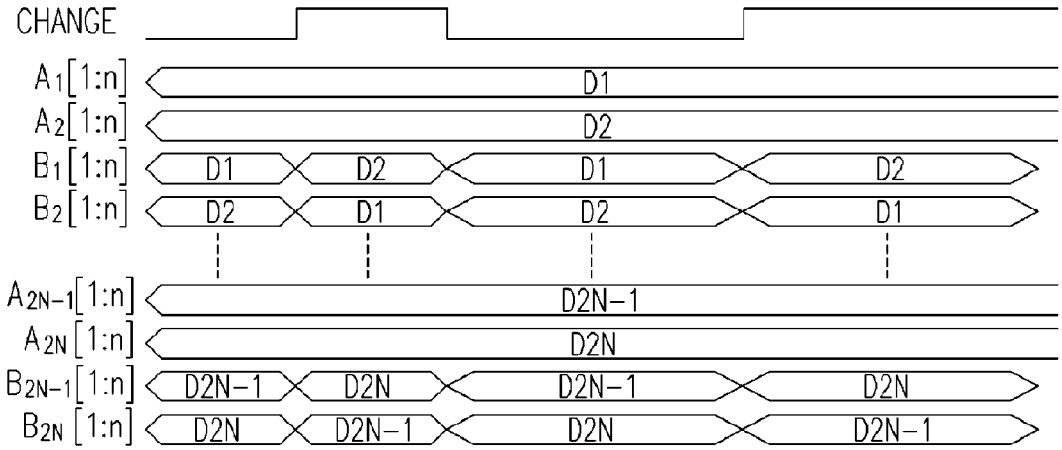
FIG. 7 is a signal timing diagram of the switching unit in FIG. 5.

FIG. 7 schematically illustrating a signal timing diagram of the switching unit 503. As shown in FIG. 7, the switching signal CHANGE has two states, i.e. the logic low level and the logic high level. If i is a positive integer and $1 \leqq i \leqq N$, the switching signal CHANGE is in the logic low level; meanwhile, the switching unit 503 outputs $A_{2i-1}$ as $B_{2i-1}$ and outputs $A_{2i}$ as $B_{2i}$. On the other hand, when the switching signal CHANGE is in the logic high level, the switching unit 503 outputs $A_{2i-1}$ as $B_{2i}$ and outputs $A_{2i}$ as $B_{2i-1}$. This operation is the so-called switching in pairs.

Although the input terminal of the switching unit 503 is electrically coupled to the line latch 502, the output terminal is electrically coupled to the level shifter 505 in FIG. 5. Alternatively, the input terminal of the switching unit 503 may be electrically coupled to the level shifter 505 and the output terminal may be electrically coupled to the DAC 506. Both connections mentioned above would provide the same function.

Figure 8:
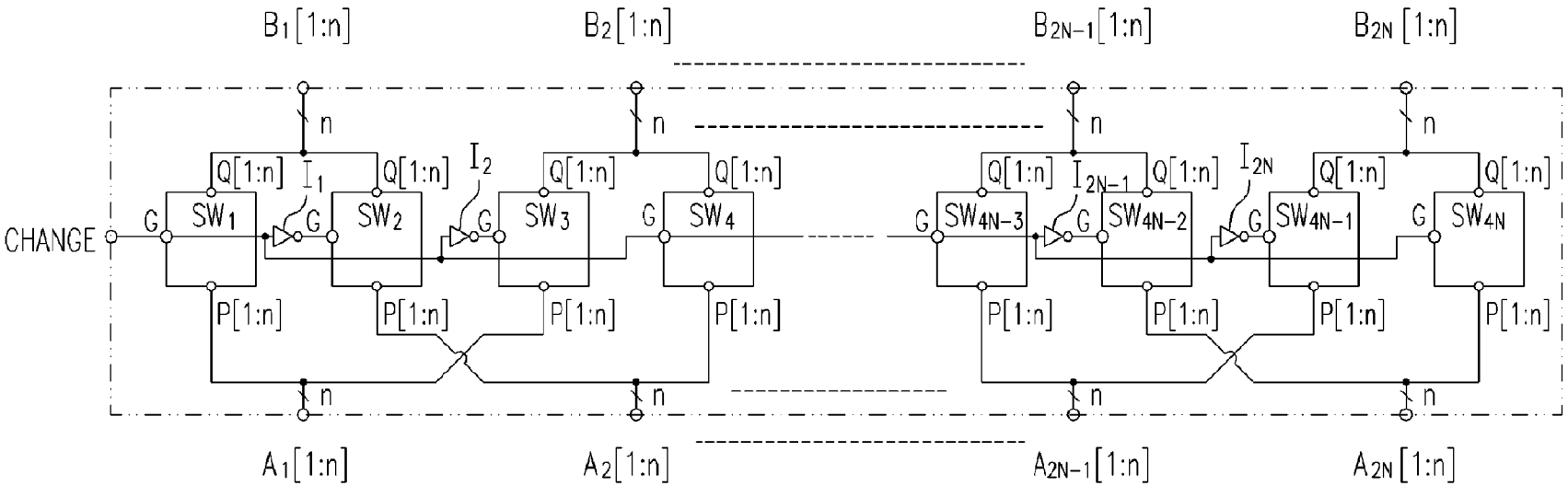
FIG. 8 is a circuit diagram of the switching unit in FIG. 5.

FIG. 8 is a circuit diagram of the switching unit 503. Referring to FIG. 8, the switching unit 503 of the present embodiment has 2N input terminals that respectively receive the input signals $A_1$~$A_{2N}$ and 2N output terminals that respectively provide the output signals $B_1$~$B_{2N}$. The switching unit 503 further comprises 2N inverters $I_1$~$I_{2N}$ and 4N switching modules $SW_1$~$SW_{4N}$. In which, all of the inverters $I_1$~$I_{2N}$ receive the switching signal CHANGE and output the inverse switching signal. If i is a positive integer and $1 \leqq i \leqq N$, the switching modules $SW_1 \sim SW_{4N}$ connect and operate as the method described below.

The operating terminal G of the switching module $SW_{4i-3}$ is electrically coupled to the switching signal CHANGE for connecting the $(2i-1)^{th}$ input terminal to the $(2i-1)^{th}$ output terminal of the switching unit 503 when the switching signal CHANGE is in the logic low level, and for disconnecting the $(2i-1)^{th}$ input terminal from the $(2i-1)^{th}$ output terminal of the switching unit 503 when the switching signal CHANGE is in the logic high level.

The operating terminal G of the switching module $SW_{4i-2}$ is electrically coupled to the inverse switching signal output by the inverter $I_{2i-1}$ for connecting the $2i^{th}$ input terminal to the $(2i-1)^{th}$ output terminal of the switching unit 503 when the inverse switching signal is in the logic low level, that is the switching signal CHANGE is in the logic high level, and for disconnecting the $2i^{th}$ input terminal from the $(2i-1)^{th}$ output terminal of the switching unit 503 when the inverse switching signal is in the logic high level, that is the switching signal CHANGE is in the logic low level.

The operating terminal G of the switching module $SW_{4i-1}$ is electrically coupled to the inverse switching signal output by the inverter $I_{2i}$ for connecting the $(2i-1)^{th}$ input terminal to the $2i^{th}$ output terminal of the switching unit 503 when the inverse switching signal is in the logic low level, that is the switching signal CHANGE is in the logic high level, and for disconnecting the $(2i-1)^{th}$ input terminal from the $2i^{th}$ output terminal of the switching unit 503 when the inverse switching signal is in the logic high level, that is the switching signal CHANGE is in the logic low level.

Finally, the operating terminal G of the switching module $SW_{4i}$ is electrically coupled to the switching signal CHANGE for connecting the $2i^{th}$ input terminal to the $2i^{th}$ output terminal of the switching unit 503 when the switching signal CHANGE is in the logic low level, and for disconnecting the $2i^{th}$ input terminal from the $2i^{th}$ output terminal of the switching unit 503 when the switching signal CHANGE is in the logic high level.

In reference to FIG. 8, the switching unit 503 is definitely able to perform the function of switching in pairs as described in FIG. 7. It is to be noted that although the switching modules $SW_1 \sim SW_{4N}$ of FIG. 8 are turned on when the input of the operating terminal G is in the logic low level, and turned off when the input of the operating terminal G is in the logic high level, the present invention is not necessarily limited by it. In other embodiments, the operation mentioned above may be totally conversed. In other words, the switching modules $SW_1 \sim SW_{4N}$ of FIG. 8 may be turned on when the input of the operating terminal G is in the logic high level, and turned off when the input of the operating terminal G is in the logic low level. Moreover, the circuit of the switching unit 503 shown in FIG. 8 is only one of the embodiments in the present invention, other circuits capable of achieving the function of switching in pairs of FIG. 7 also applicable in the present invention and also regarded as within the scope of the present invention.

Figure 9:
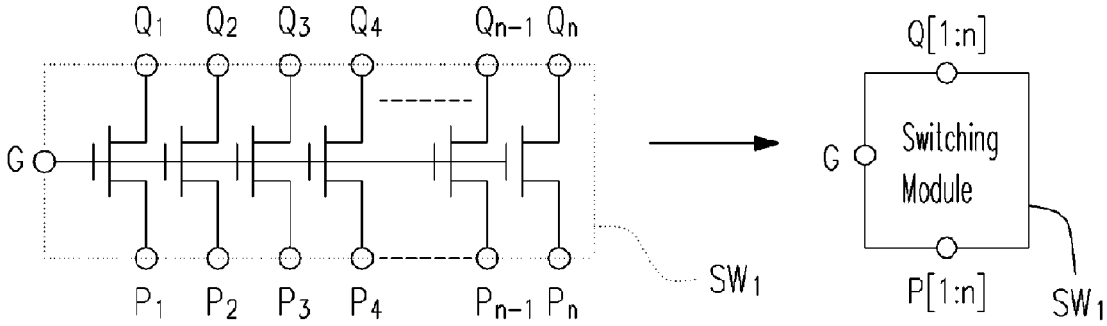
FIG. 9 is a circuit diagram of the switching module in FIG. 8.

In the present embodiment, the structures of the switching modules $SW_1 \sim SW_{4N}$ are all the same. Using the switching module $SW_1$ as an example, FIG. 9 is a circuit diagram of the switching module $SW_1$. The switching module $SW_1$ has an operating terminal G, an n-bit input terminal P[1:n], and an n-bit output terminal Q[1:n]. The input terminal P[1:n] and the output terminal Q[1:n] may be regarded as $P_1 \sim P_n$ and $Q_1 \sim Q_n$ when the n bits are separated. The switching module $SW_1$ comprises n switching apparatus. In the present embodiment, all of the switching apparatuses mentioned above are the Metal Oxide Semiconductor Field Effect Transistors (MOSFET or MOS transistor). As shown in FIG. 9, the operating terminal G is connected to the gates of all MOS transistors. In addition, if k is an integer and $1 \leqq k \leqq N$, the $k^{th}$ MOS transistor among the N MOS transistors connects or disconnects the input terminal $P_k$ to/from the output terminal $Q_k$ according to the input state of the operating terminal G.

In summary, in the present invention, a special designed data switching circuit is used to switch the data signal in pairs between the output channels of the source driver, and a special designed pixel array is used to transmit the switched data signal to the proper sub-pixel. In addition, if the dot inversion driving method is used, a positive polarity voltage or a negative polarity voltage is continuously outputted from the same output channel during the same frame, such that it is not required to switch between positive polarity and negative polarity. Accordingly, the swing voltage output from the source driver is reduced, and the power consumption is further reduced.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A data switching circuit, comprising:

a control unit for providing a switching signal, wherein the switching signal comprises a first state and a second state, and the state of the switching signal is changed every time when each of the frames and each of the scan lines of a TFT LCD is started; and a switching unit comprising:

4N switching modules, wherein an operating terminal of the $(4i-3)^{th}$ switching module electrically is coupled to the switching signal, when the switching signal is in the first state, the $(2i-1)^{th}$ input terminal is connected to the $(2i-1)^{th}$ output terminal, and when the switching signal is in the second state, the $(2i-1)^{th}$ input terminal is disconnected from the $(2i-1)^{th}$ output terminal;

an operating terminal of the $(4i-2)^{th}$ switching module is electrically coupled to a first inverse switching signal, when the inverse switching signal is in the first state, the $2i^{th}$ input terminal is connected to the $(2i-1)^{th}$ output terminal, and when the first inverse switching signal is in the second state, the $2i^{th}$ input terminal is disconnected from the $(2i-1)^{th}$ output terminal;

an operating terminal of the $(4i-1)^{th}$ switching module is electrically coupled to a second inverse switching signal, when the second inverse switching signal is in the first state, the $(2i-1)^{th}$ input terminal is connected to the $2i^{th}$ output terminal, and when the second inverse switching signal is in the second state, the $(2i-1)^{th}$ input terminal is disconnected from the $2i^{th}$ output terminal; and an operating terminal of the $4i^{th}$ switching module is electrically coupled to the switching signal, when the switching signal is in the first state, the $2i^{th}$ input terminal is connected to the $2i^{th}$ output terminal, and when the switching signal is in the second state, the $2i^{th}$ input terminal is disconnected from the $2i^{th}$ output terminal, wherein N and i are positive integers, and $1 \leqq i \leqq N$.

2. The data switching circuit of claim 1, wherein the control unit receives a frame start signal and a scan line start signal, the frame start signal is synchronized with each frame start of the TFT LCD, the scan line start signal is synchronized with each scan line start of the TFT LCD, and the switching signal is generated according to the frame start signal and the scan line start signal.

3. The data switching circuit of claim 1, wherein the switching unit further comprises:

2N inverters for respectively receiving the switching signal, wherein the first inverse switching signal is outputted from the $(2i-1)^{th}$ inverter, and the second inverse switching signal is outputted from the $2i^{th}$ inverter.

4. The data switching circuit of claim 3, wherein each input terminal of the switching unit respectively receives a n-bit signal, each output terminal of the switching unit respectively outputs a n-bit signal, and each switching module comprises n switching apparatus, wherein the $k^{th}$ switching apparatus connects the $k^{th}$ bit of the input terminal to the $k^{th}$ bit of the output terminal or disconnects the $k^{th}$ bit of the input terminal from the $k^{th}$ bit of the output terminal according to an input state of the operating terminal, where the input terminal and the output terminal are corresponded to the switching apparatus, n is a positive integer and $1 \leqq k \leqq n$.

5. The data switching circuit of claim 4, wherein all of the switching apparatus are metal oxide semiconductor field effect transistors (MOSFET or MOS transistor).

6. The data switching circuit of claim 1, wherein the input terminal of the switching unit is electrically coupled to a line latch of a source driver, and the output terminal of the switching unit is electrically coupled to a level shifter of the source driver.

7. The data switching circuit of claim 1, wherein the input terminal of the switching unit is electrically coupled to a level shifter of a source driver, and the output terminal of the switching unit is electrically coupled to a digital-to-analog converter (DAC).

8. The data switching circuit of claim 1, wherein the first state is a logic high level, and the second state is a logic low level.

9. The data switching circuit of claim 1, wherein the first state is a logic low level, and the second state is a logic high level.

10. A source driver, comprising:

a line latch; electrically coupled to the input terminal of the switching unit a control unit for providing a switching signal, wherein the switching signal comprises a first state and a second state, and the state of the switching signal is changed every time when each of the frames and each of the scan lines of a TFT LCD is started;

a switching unit comprising:

4N switching modules, wherein an operating terminal of the $(4i-3)^{th}$ switching module is electrically coupled to the switching signal, when the switching signal is in the first state, the $(2i-1)^{th}$ input terminal is connected to the $(2i-1)^{th}$ output terminal, and when the switching signal is in the second state, the $(2i-1)^{th}$ input terminal is disconnected from the $(2-1)^{th}$ output terminal;

an operating terminal of the $(4i-2)^{th}$ switching module is electrically coupled to a first inverse switching signal, when the first inverse switching signal is in the first state, the $2i^{th}$ input terminal is connected to the $(2i-1)^{th}$ output terminal, and when the first inverse switching signal is in the second state, the $2i^{th}$ input terminal is disconnected from the $(2i-1)^{th}$ output terminal;

an operating terminal of the $(4i-1)^{th}$ switching module is electrically coupled to a second inverse switching signal, when the second inverse switching signal is in the first state, the $(2i-1)^{th}$ input terminal is connected to the $2i^{th}$ output terminal, and when the second inverse switching signal is in the second state, the $(2i-1)^{th}$ input terminal is disconnected from the $2i^{th}$ output terminal; and an operating terminal of the $4i^{th}$ switching module is electrically coupled to the switching signal, when the switching signal is in the first state, the $2i^{th}$ input terminal is connected to the $2i^{th}$ output terminal, and when the switching signal is in the second state, the $2i^{th}$ input terminal is disconnected from the $2i^{th}$ output terminal, wherein N and i are positive integers, and $1 \leqq i \leqq N$; and a digital-to-analog converter (DAC), electrically coupled to the output terminal of the switching unit.

11. The source driver of claim 10, wherein the control unit receives a frame start signal and a scan line start signal, the frame start signal is synchronized with each frame start of the TFT LCD, the scan line start signal is synchronized with each scan line start of the TFT LCD, and the switching signal is generated according to the frame start signal and the scan line start signal.

12. The source driver of claim 10, wherein the switching unit further comprises:

2N inverters for respectively receiving the switching signal, wherein the first inverse switching signal is outputted from the $(2i-1)^{th}$ inverter, and the second inverse switching signal is outputted from the $2i^{th}$ inverter.

13. The source driver of claim 12, wherein each input terminal of the switching unit respectively receives a n-bit signal, each output terminal of the switching unit respectively outputs a n-bit signal, and each switching module comprises n switching apparatus, wherein the $k^{th}$ switching apparatus connects the $k^{th}$ bit of the input terminal to the $k^{th}$ bit of the output terminal or disconnects the $k^{th}$ bit of the input terminal from the $k^{th}$ bit of the output terminal according to an input state of the operating terminal, where the input terminal and the output terminal are corresponded to the switching apparatus, n is a positive integer and $1 \leqq k \leqq n$.

14. The source driver of claim 13, wherein all of the switching apparatus are metal oxide semiconductor field effect transistors (MOSFET or MOS transistor).

15. The source driver of claim 10, wherein the first state is a logic high level, and the second state is a logic low level.

16. The source driver of claim 10, wherein the first state is a logic low level, and the second state is a logic high level.

17. The source driver of claim 10, further comprising:

a shift register electrically coupled to the input terminal of the line latch.

18. The source driver of claim 10, further comprising:

a level shifter electrically coupled between the line latch and the switching unit.

19. The source driver of claim 10, further comprising:

a level shifter electrically coupled between the switching unit and the digital-to-analog converter (DAC).

20. The source driver of claim 10, further comprising:

an output buffer electrically coupled to the output terminal of the digital-to-analog converter (DAC).

* * * * *